United States Patent [19]

Liu et al.

[11] 4,251,183

[45] Feb. 17, 1981

[54] CROSSOVER DUCT ASSEMBLY

[75] Inventors: Hsin-Tuan Liu, Scottsdale; George L. Perrone; Leo E. Gambee, both of Phoenix, all of Ariz.

[73] Assignee: The Garrett Corp., Los Angeles, Calif.

[21] Appl. No.: 873,639

[22] Filed: Jan. 30, 1978

[51] Int. Cl.[2] ..... F04D 17/12

[52] U.S. Cl. ..... 415/198.1; 138/39; 415/199.2; 415/211; 415/219 C

[58] Field of Search ..... 415/198.1, 199.1, 199.2, 415/181, 211, 219 C, 189, 193, 199.6, 187, 217, 218, DIG. 1; 138/39, 155

[56] References Cited

U.S. PATENT DOCUMENTS

| | | | |
|---|---|---|---|
| 871,341 | 11/1907 | Jaeger | 415/199.2 X |
| 2,063,194 | 12/1936 | Roy | 415/198.1 X |
| 2,303,949 | 12/1942 | Nordell | 138/39 |
| 2,419,669 | 4/1947 | Birmann | 415/211 |
| 2,648,491 | 8/1953 | Wood | 415/211 X |
| 2,661,594 | 12/1953 | Petrie | 415/199.1 X |
| 3,044,684 | 7/1962 | Fullemann | 415/199.2 |
| 3,706,510 | 12/1972 | O'Connor | 415/145 |
| 3,797,085 | 3/1974 | Aartman | 29/156.8 R |
| 3,927,763 | 12/1975 | Strub et al. | 415/199.2 X |
| 3,964,837 | 6/1976 | Exley | 415/181 |
| 4,027,997 | 6/1977 | Bryans | 415/207 |
| 4,087,200 | 5/1978 | Korenblit et al. | 415/199.2 |

FOREIGN PATENT DOCUMENTS

| | | | |
|---|---|---|---|
| 411749 | 6/1910 | France | 415/211 |
| 411913 | 6/1910 | France | 415/199.2 |
| 807932 | 1/1937 | France | 415/199.2 |
| 1002707 | 3/1952 | France | 415/181 |
| 414433 | 7/1974 | U.S.S.R. | 415/198 R |

*Primary Examiner*—Everette A. Powell, Jr.
*Attorney, Agent, or Firm*—Albert J. Miller; Joel D. Talcott; Stuart O. Lowry

[57] ABSTRACT

A crossover duct assembly for providing flow communication between multiple stages of centrifugal compressors and the like. The duct assembly includes inner and outer wall sections forming a continuous annular flow path between compressor stages for turning radially outward gas flow to a radially inward direction. The duct includes a thin vane diffuser section, a vaneless turning bend having an elongated wall geometry, and a deswirl vane section for enhancing smooth gas flow with minimum pressure loss.

57 Claims, 6 Drawing Figures

CROSSOVER DUCT ASSEMBLY

BACKGROUND OF THE INVENTION

The invention of this application relates in subject matter to concurrently filed application Ser. No. 873,638 entitled "Crossover Duct" in the name of Hsin-Tuan Liu.

This invention relates to machines such as turbine engines having multiple stage compressors. More specifically, this invention relates to a pneumatic crossover duct for providing flow-efficient communication between adjacent stages of a multiple stage compressor.

In the prior art, multiple stage compressors are found in a wide variety of applications. For example, a dual or multiple stage compressor is commonly used for supplying compressed charge air to a combustor section of a turbine engine. That is, ambient air is compressed by a first compressor, and then ducted to a second or subsequent compressor for obtaining increasingly higher levels of compression. Then, the highly compressed charge air is supplied to the engine combustor section including a combustion chamber for admixture with a suitable turbine fuel. The air-fuel mixture in the combustion chamber is ignited, and the hot products of combustion are utilized to rotate one or more turbine wheels at high speeds to obtain a relatively high power engine output.

In many multiple stage compressors, one or more centrifugal-type compressor wheels are commonly used. Such compressor wheels function to convert an axially entering gas stream into a radially outwardly directed compressed stream. With centifugal compressor wheels, a generally annular pneumatic crossover duct is necessarily provided between compressor stages for turning the compressed gas from a radially outward direction back toward the next compressor stage in series for further compression. In such pneumatic crossover ducts, aerodynamic considerations are of high importance in that it is desirable to couple the compressed gas stream to subsequent compressor stages with a minimum of flow turbulence, and a minimum of efficiency and pressure losses.

Crossover ducts in the prior art typically comprise one or more duct wall members forming a generally U-shaped gas flow path between compressor stages, and including a plurality of relatively thick vanes along the flow path. The vanes serve to position the wall members in approximately the desired aerodynamic configuration, and provide the duct wall members with structural rigidity. In some duct constructions, the vanes are disposed along the curved end portion, or turning bend, of the duct for assisting in turning the gas flow. See, for example, U.S. Pat. No. 3,361,073. such positioning of the vanes, however, has been found to interfere to some degree with air flow, and thereby does not result in an optimum aerodynamic configuration. Other prior art duct constructions have substituted the vanes in the turning bend with separate sets of diffuser vanes and deswirl vanes in the gas entrance and gas exit portions, respectively, of the duct. See, for example, U.S. Pat. Nos. 2,661,594; 2,797,858; 2,827,261; 2,967,013; and 3,409,340. However, this has required that relatively thick diffuser vanes be positioned in the gas entrance portion of the duct in order to assure the structural rigidity of the duct. Aerodynamically, the use of thick diffuser vanes results in undesirable efficiency of gas flow and undesirable pressure losses.

This invention overcomes the problems and disadvantages of the prior art by providing a structurally sound crossover duct having a vaneless turning bend configured to maximize efficiency and to minimize pressure losses, and including thin diffuser vanes shaped aerodynamically for improved flow efficiency and reduced pressure loss characteristics.

SUMMARY OF THE INVENTION

In accordance with the invention, a pneumatic crossover duct assembly for directing compressed gas between a pair of compressor stages comprises an inner wall and an outer wall cooperating to form a generally annular gas flow passage having a generally U-shaped cross section. Specifically, the inner and outer walls of the duct form a gas flow path communicating with the first compressor stage, and extending radially outwardly into a curved end portion, or turning bend, of generally about 180°. From the turning bend, the inner and outer duct walls blend into a radially inwardly directed flow path extending toward the second compressor stage.

A plurality of radially extending thin diffuser vanes are circumferentially spaced around the duct between the first compressor stage and the turning bend. Each diffuser vane has a thin substantially uniform thickness along its length, and its width spans axially between the duct inner and outer walls to help direct compressed swirling gas entering the duct in a radially outward direction. The suction surfaces of the leading edges of the diffuser vanes are aerodynamically contoured to provide a leading edge wedge angle of about two or more degrees to reduce the incidence of the flow with respect to the suction surfaces of the vanes, and thereby reduce diffuser pressure loss and extend diffuser range.

The turning bend of the crossover duct is shaped with an elongated inner and outer wall geometry to improve flow efficiency and to reduce pressure losses. Specifically, the inner wall and the outer wall are both shaped to have a modified semi-elliptical geometry, whereby both walls are elongated compared to a conventional radial curvature. The outer wall and the inner wall of the turning bend each comprise an entrance quadrant and an exit quadrant, whereby the walls of the turning bend each have a generally semi-elliptical configuration. Importantly, the ratio of the major axis to the minor axis is at least about 1.20 for each inner wall quadrant, and at least about 1.15 for each outer wall quadrant.

In the preferred embodiment, the crossover duct includes arcuately shaped, circumferentially spaced deswirl vanes along the gas flow path between the turning bend and the second compressor stage. The deswirl vanes serve to reduce tangential swirl of the compressed gas exiting the turning bend, and thereby further reduce pressure losses.

The crossover duct is assembled from a plurality of preformed components which may be formed from sheet materials, castings, moldings, and the like. The inner and outer walls of the duct each comprise a pair of separate wall exit sections shaped to complete the turning bend and to form the radially inwardly directed flow path, or exit portion, of the duct. The deswirl vanes maintain the desired spacing between the exit sections and a first series of bolts are received through the deswirl vanes to secure the inner and outer wall exit sections with the inner wall entrance section. The outer walls of the duct entrance and exit sections are then secured together as by a second series of bolts to provide a rigid duct assembly with the thin diffuser vanes appropriately retained in the desired position.

BRIEF DESCRIPTION OF THE DRAWINGS

The accompanying drawings illustrate the invention. In such drawings.

DETAILED DESCRIPTION OF THE PREFERRED EMBODIMENT

Figure 1:
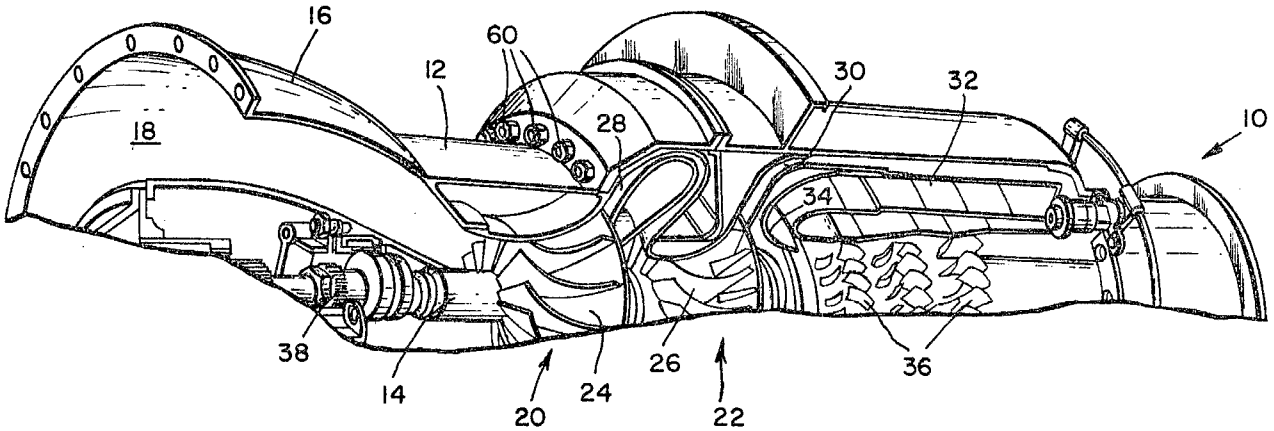
FIG. 1 is a fragmented perspective view of a turbine engine broken away to show a crossover duct of this invention.

A turbine engine 10 is shown in FIG. 1, and generally comprises a cylindrical engine housing 12 in which is mounted a longitudinally extending power shaft 14. The housing 12 has its forward end 16 flared outwardly to form an open air inlet 18 for passage of air through a pair of axially aligned compressor stages 20 and 22, respectively. The compressor stages 20 and 22 comprise centrifugal compressor wheels 24 and 26 mounted on the power shaft 14 for rotation therewith. Alternately, the latter compressor 22 may comprise an axial compressor if desired. Air supplied axially to the first centrifugal compressor wheel 24 is compressed and discharged radially outwardly into a crossover duct 28 of this invention. The crossover duct 28 serves to turn the radially outwardly directed air to a radially inward direction for axial supply to the second compressor wheel 26. The second wheel 26 further compresses the air, and discharges the air outwardly through a duct 30 leading to a combustion chamber 32. In the combustion chamber 32, the air is mixed with a suitable fuel and ignited whereupon the hot exhaust products are directed through a duct 34 to rotatably drive a series of turbine wheels 36 mounted on the shaft 14. Output for the engine may be taken via a gear 38 on the shaft 14, or alternately, in the form of thrust as in a jet propulsion aircraft engine.

Figure 2:
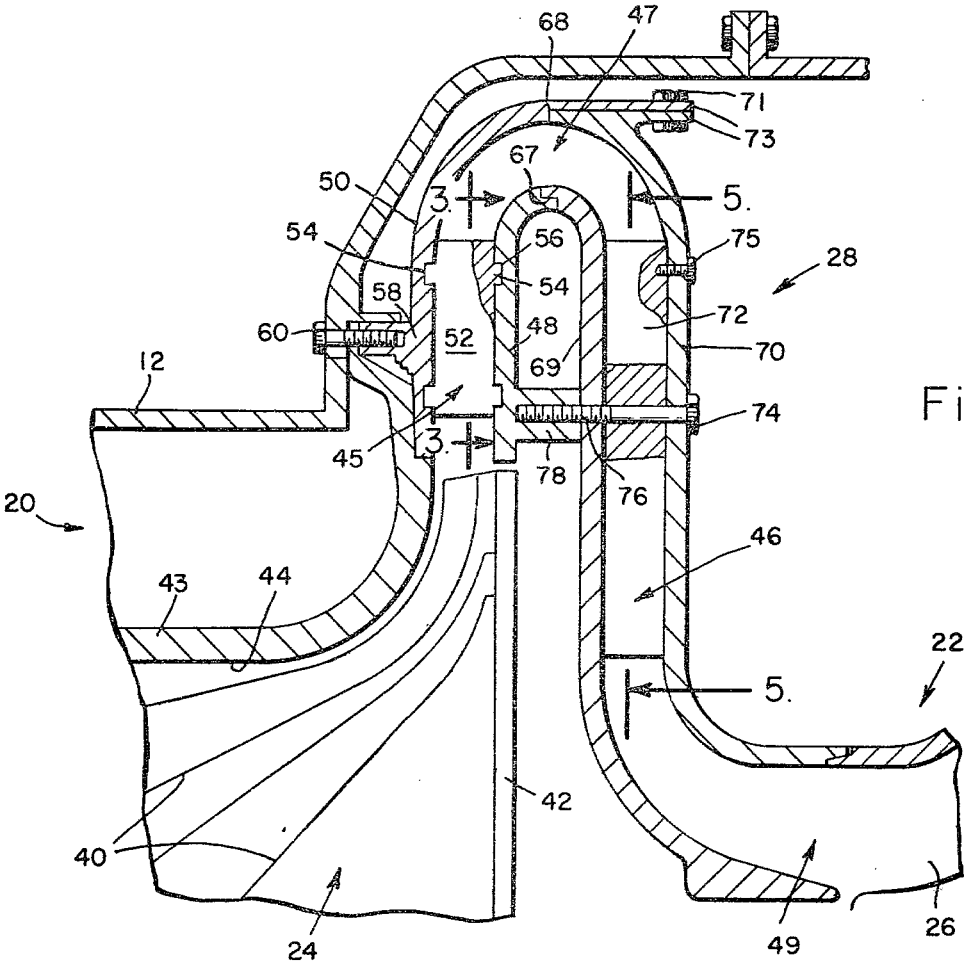
FIG. 2 is an enlarged fragmented vertical section of the duct.

As shown in FIG. 2, the first compressor wheel 24 comprises a plurality of forwardly-facing impeller blades 40 formed integrally with a circular backing plate 42. The plate 42 and a shroud 43 mounted on the engine housing 12 together form a chamber 44 for the first compressor stage 20. As the compressor wheel 24 is rotated on the power shaft 14, air is drawn through the inlet 18 axially into the compressor wheel 24. The air is compressed by the impeller blades 40, and is discharged radially outwardly about the circumference of the wheel 24 into the crossover duct 28 of this invention.

The crossover duct 28 comprises a continuous annular passage providing flow communication between the two compressor stages 20 and 22. More specifically, the crossover duct 28 has a gas entrance portion defining a radially outwardly directed gas flow path blending into a generally U-shaped turning bend 47 for turning the swirling, radially outwardly directed gas flow back toward a radially inward direction. The turning bend 47 in turn blends with a gas exit portion defining a radially inwardly directed gas flow path 46 which guides the compressed gas flow inwardly toward the second compressor wheel 26. Of course, as shown, the radially inwardly directed flow path may terminate in an axially turned portion 49 for supplying the compressed gas axially to the second wheel 26.

Figure 3:
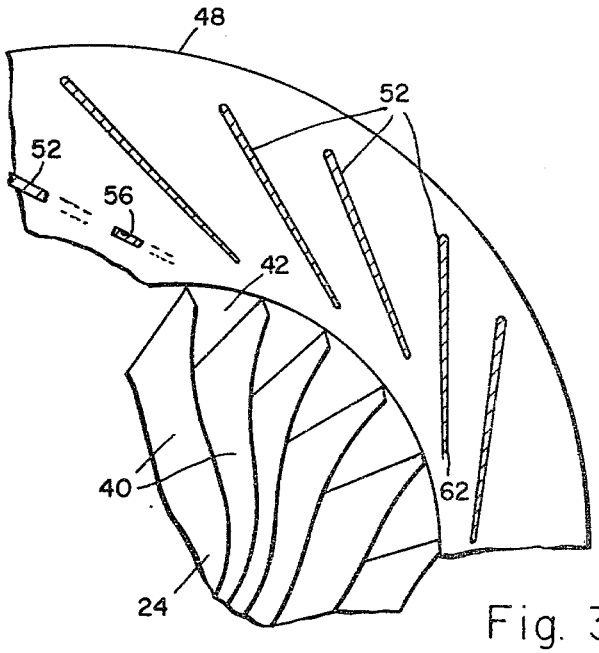
FIG. 3 is an enlarged vertical section taken on the line 3—3 of FIG. 2.
Figure 4:
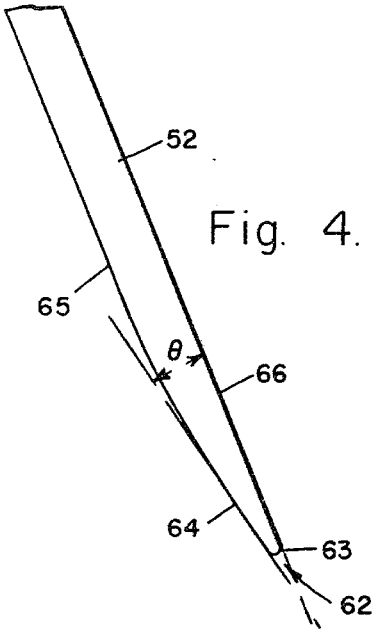
FIG. 4 is an enlarged fragmented elevation view of a portion of a thin diffuser vane of the duct.

The gas entrance portion of the crossover duct 28 comprises an annular inner wall section 48 and an annular outer wall section 50. The wall sections 48 and 50 are spaced from each other to form the radially outward flow path 48, and position and support a plurality of circumferentially spaced thin diffuser vanes 52 as shown in FIGS. 2 through 4. These vanes 52 each have tabs 54 on opposite sides received in aligned pre-formed slots 56 in said wall sections 48 and 50. Or, if desired, the diffuser blades 52 may be fastened to the wall sections 48 and 50 as by brazing, or by other suitable mounting techniques. Finally, the outer wall section 50 includes a plurality of circumferentially spaced, exteriorly facing bosses 58 into which a plurality of bolts 60 are threadably received to secure the entire gas entrance portion with respect to the engine housing 12, and to align the wall sections 48 and 50 to receive the compressed air discharged from the first compressor stage 20.

As shown in FIGS. 3 and 4, the diffuser vanes 52 are angularly set with respect to the radially outward direction of air flow through the crossover duct 28. The angular positions of the diffuser vanes 52 are selected to assist in turning the compressed air flow exiting the first compressor wheel 24 to flow in a radially outward direction, and to help remove swirling circumferential components of air velocity. Importantly, as shown in FIG. 4, the diffuser vanes are thin, and the leading edge 62 of each diffuser vane 52 is aerodynamically contoured with respect to the remainder of the vane length to form a leading edge wedge angle $\theta$ of at least about two degrees or more, and preferably between about four to ten degrees. More specifically, the thin vanes have a length of at least about seventy-five times their maximum thickness, and the leading edge 62 of each diffuser vane 52 is formed to have a rounded nose 63 preferably having a thickness of about one-half or less of the normal thickness of the vane. The nose 63 of each leading edge 62 is formed adjacent the pressure surface 66 of the vane whereby an angularly disposed contoured surface 64 is formed adjacent the leading edge 62 on the vane suction surface 65. As illustrated in FIG. 4, this contoured surface 64 is formed generally at angle $\theta$ with respect to the vane pressure surface 66, and defines the vane leading edge wedge angle. In a preferred embodiment, the contoured surface 64 is formed generally as a portion of an ellipse, although it may approach a straight line configuration. This shaping of the diffuser vane leading edges 62 has been found to improve the smoothness of the air flow through the crossover duct by reducing the incidence of air flow upon the vane suction surface 65. Conveniently, this aerodynamic contouring, has been found to work equally well with single or multiple-row diffuser vane constructions.

As shown in FIG. 2, the inner and outer wall sections 48 and 50 of the duct entrance portion extend radially outwardly in parallel from the compressor wheel 24 to form the radially outward flow path 45, and then curve together into the turning bend 47 to form one-half, or about 90°, of the turning bend. The inner and outer wall sections 48 and 50 include shaped ends 67 and 68 for matingly engaging and abutting the inner and outer wall sections 69 and 70, respectively, of the duct exit portion to form the remainder of the continuous, U-shaped duct passage. That is, the inner and outer wall sections 69 and 70 abut the associated walls 48 and 50, and then curve radially inwardly in parallel to complete the second half of the turning bend 47 and to form the radially inward flow path 46.

Figure 5:
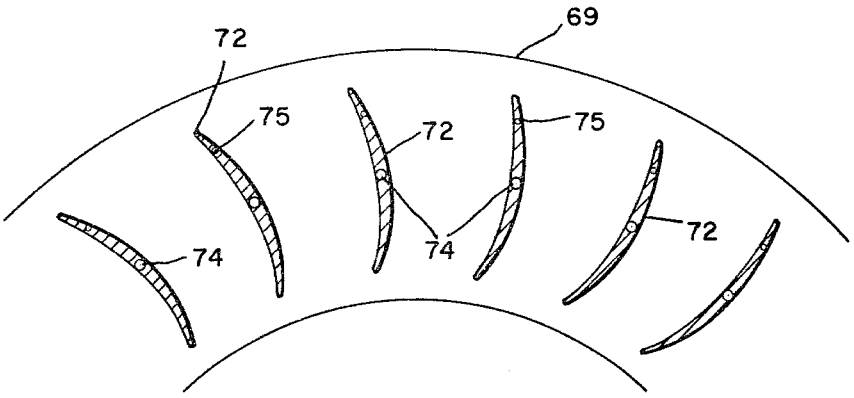
FIG. 5 is an enlarged vertical section taken on the line 5—5 of FIG. 2.

The inner and outer wall sections 69 and 70 of the duct exit portion are maintained in a predetermined parallel spatial relationship by a plurality of circumferentially spaced deswirl vanes 72. More specifically, as shown in FIG. 5, each deswirl vane 72 comprises an elongated crescent-shaped strip of metal or the like having a thickness decreasing outwardly from its center toward its opposite ends. The vanes 72 each have an arcuate shape, and are positioned between the walls 69 and 70 by mounting bolts 74 and positioning bolts 75. The mounting bolts 74 are received through the centers of said vanes, and through preformed holes 76 in the wall sections 69 and 70, and then fastened into bosses 78 formed exteriorly on the inner wall section 48 of the duct entrance portion (FIG. 2). The positioning bolts 75 are received through the exit portion outer wall section 70, and fastened into the vanes 72 near the ends of the vanes. In this manner, the deswirl vanes 72 are angularly positioned between the wall sections 69 and 70, with the exit portion of the crossover duct 28 securely fastened to the inner wall section 48 of the entrance section. Then, the duct outer wall sections 50 and 70 are connected together by bolts 71 received through exteriorly formed flanges 73 to complete a rigid crossover duct construction. Alternately, if desired, the deswirl vanes 72 may be mounted on either or both of the wall sections 69 and 70 as by brazing, or they may be molded integrally with either one of said walls 69 and 70.

The turning bend 47 of the crossover duct 28 is aerodynamically shaped for optimum efficiency of air passage without substantial turbulence or pressure loss. Specifically, as shown in FIGS. 2 and 6, the outer wall sections 50 and 70 of the crossover duct 28, and the inner wall sections 48 and 69 are shaped to comprise continuous turning wall geometries each having a modified generally semi-elliptical shape which is elongated relative to conventional radially-formed geometry.

Figure 6:
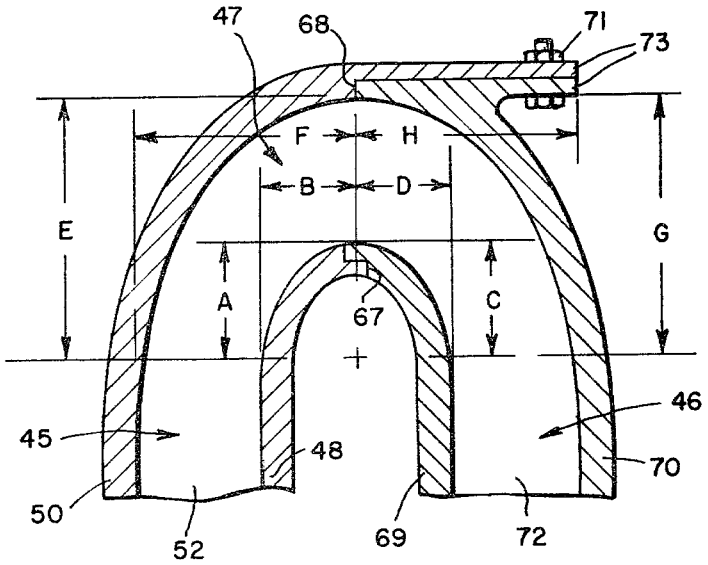
FIG. 6 is an enlarged fragmented elevation view of the duct turning bend.

As shown in FIG. 6, the inner wall section 48 is shaped to form one quadrant of an ellipse having a major and minor axis representatively identified by letters (A) and (B), and the inner wall section 69 is shaped to form a second quadrant of an ellipse having a major and minor axis representatively identified by letters (C) and (D). Together, the inner wall sections 48 and 69 form a continuous, generally semi-elliptical configuration forming the inner wall of the turning bend 47. In a similar manner, the outer wall section 50 is shaped to form one quadrant of an ellipse which blends into a second quadrant formed by the exit portion outer wall section 70. The major and minor axes of the outer wall quadrants are representatively identified by the letters (E) and (F), and (G) and (H), respectively. Importantly, for optimum aerodynamic performance, the ratio of the major and minor axes of each of the inner wall elliptical quadrants is at least about 1.20, and the ratio of the major and minor axes of each of the outer wall elliptical quadrants is at least about 1.15. These ratios have been found to provide relatively elongated turning bend wall geometries which reduce deleterious boundary layer effects through the turning bend 47, and thereby reduce crossover duct pressure losses.

The crossover duct of this invention is easily assembled with all components maintained in the desired aerodynamically optimum position. The inner wall sections 48 and 69, which may be formed as a single component, are bolted onto the exit portion outer wall section 70 by means of the bolts 74 with the deswirl vanes 72 in the desired position. Then, this subassembly is fixed to the entrance portion outer wall section 50 by means of the bolts 71 to provide a rigid duct assembly with the thin diffuser vanes 52 properly supported in the desired position. Finally, the entire duct assembly is secured to the engine housing by the bolts 60.

A wide variety of modifications and improvements in the crossover duct of the invention are believed to be possible without varying from the scope of the invention. In particular, the duct may be used wherever it is necessary to smoothly and efficiently turn swirling gas flow from a radially outward to a radially inward direction. Further, the duct components may be cast, or formed from a wide variety of suitable materials and methods utilizing the same aerodynamic principles.

What is claimed is:

1. A crossover duct assembly for turning radially outward gas flow to a radially inward direction comprising a generally U-shaped duct inner wall; a generally U-shaped duct outer wall for cooperating with said inner wall to form a generally U-shaped gas flow path having a gas entrance portion, a turning bend, and an exit portion, said inner wall and said outer wall each including a first section along the entrance portion and a second section along the exit portion; first means for connecting said first and second inner wall sections together and with respect to said second outer wall section and for maintaining the spacing between said second inner and outer wall sections to form the duct exit portion; and second means for connecting said first and second outer wall sections and for maintaining the spacing between said first inner and outer wall sections to form the duct entrance portion, said second means including a plurality of relatively thin diffuser vanes extending between said first inner and outer wall sections.

2. A crossover duct assembly as set forth in claim 1 wherein said duct inner and outer walls cooperate to form an annular gas flow path having a generally U-shaped cross section for turning radially outward gas flow to a radially inward direction.

3. A crossover duct assembly as set forth in claim 1 wherein said first outer wall section extends along the duct entrance portion and at least part of the duct turning bend.

4. A crossover duct assembly as set forth in claim 1 wherein said second outer wall section extends along the duct exit portion and at least part of the duct turning bend.

5. A crossover duct assembly as set forth in claim 1 wherein said first outer wall section extends along the duct entrance portion and part of the turning bend, and said second outer wall section extends along the duct exit portion and part of the turning bend.

6. A crossover duct assembly as set forth in claim 1 wherein said first means comprises a plurality of deswirl vanes extending between the second duct outer wall section and the second inner wall section, and fastening means for fastening said deswirl vanes in position with respect to said second outer wall section and said second inner wall section.

7. A crossover duct assembly as set forth in claim 6 wherein said fastening means comprises a plurality of bolts, each of said deswirl vanes having a bolt received therethrough and interconnecting said second outer wall section and said first and second inner wall sections.

8. A crossover duct assembly as set forth in claim 6 wherein each of said deswirl vanes comprises a generally cresent-shaped vane for maintaining the spacing between the second outer wall section and the second inner wall section, and including means for angularly securing said vanes with respect to the duct exit portion.

9. A crossover duct assembly as set forth in claim 1 wherein said diffuser vanes are each angularly set with respect to the duct entrance portion, each of said vanes having a leading edge incident to radially outward gas flow, and a pressure surface and a suction surface said suction surface being contoured adjacent the leading edge to form a leading edge wedge angle with respect to the pressure surface of at least about two degrees.

10. A crossover duct assembly as set forth in claim 1 wherein each of said diffuser vanes has a length of at least about seventy-five times its thickness.

11. A crossover duct assembly as set forth in claim 1 wherein the turning bend of said gas flow path is formed to have a generally semi-elliptical cross section, said inner wall including along the turning bend a pair of generally elliptical quadrants each having a ratio of major to minor axis of at least 1.20, and said outer wall including along the turning bend a pair of generally elliptical quadrants each having a ratio of major to minor axis of at least about 1.15.

12. A crossover duct assembly as set forth in claim 11 wherein one of the pair of generally elliptical quadrants of said outer wall along the turning bend is formed by said first outer wall section, and the other of said outer wall quadrants is formed by said second outer wall section.

13. A crossover duct assembly as set forth in claim 11 wherein said first inner wall section forms one of said pair of elliptical inner wall quadrants and said second inner wall section forms the other of said inner wall quadrants.

14. A crossover duct assembly as set forth in claim 1 wherein said first and second outer wall sections include exteriorly formed flanges, and said second means includes a plurality of bolts received through said flanges for connecting said first and second sections together.

15. In a multiple stage compressor having at least two compressor stages carried within a housing, a method of making a crossover duct assembly to turn radially outward gas flow to a radially inward direction comprising the steps of forming a generally annular inner wall and a generally annular outer wall each having a generally U-shaped cross section and cooperating to form an annular gas flow path of a generally U-shaped cross section including a gas entrance portion, a turning bend, and an exit portion, said inner and outer walls each having a first section along the entrance portion and at least part of the turning bend, and a second section along the exit portion and at least part of the turning bend; positioning a plurality of circumferentially spaced deswirl vanes between the second inner and outer wall sections; connecting said second inner and outer wall sections with respect to each other and with respect to said first inner wall section; positioning a plurality of relatively thin diffuser vanes between said first inner and outer wall sections; connecting said first and second outer wall sections together to form the duct assembly; and mounting the crossover duct assembly with respect to the compressor housing.

16. A crossover duct assembly as set forth in claim 1 wherein said first outer wall section and said first inner wall section along the entrance portion include aligned tab-receiving openings, and said diffuser vanes each include opposed tabs for reception in said openings whereby said diffuser vanes are mounted between said first outer wall section and said first inner wall section for maintaining the spacing therebetween.

17. A crossover duct assembly for turning radially outward gas flow to a radially inward direction comprising an annular inner wall and an annular outer wall each having a generally U-shaped cross section and cooperating to form an annular gas flow path of a generally U-shaped cross section including a gas entrance portion, turning bend, and exit portion, said inner and outer walls each including a first section along the entrance portion and a second section along the exit portion; first means for connecting said first and second inner wall sections together and with respect to said second outer wall section to form the duct exit portion with said second inner and outer wall sections spaced from each other; second means for connecting said first and second outer wall sections together; and a plurality of relatively thin circumferentially spaced diffuser vanes connected between said first inner and outer wall sections to space the same from each other to form the duct entrance portion and to assist gas flow therethrough.

18. A crossover duct assembly as set forth in claim 17 wherein said first means comprises a plurality of circumferentially spaced deswirl vanes extending between the second inner and outer duct sections, and fastening means received through said deswirl vanes for fastening said deswirl vanes in position.

19. A crossover duct assembly as set forth in claim 18 wherein said fastening means comprises a series of bolt-receiving bosses formed exteriorly on said first inner wall sections for positioning said first and second inner wall sections with respect to each other, and a plurality of bolts received through said second inner and outer wall sections and said deswirl vanes and fastened into said bosses.

20. A crossover duct assembly as set forth in claim 18 including means for angularly securing each of said deswirl vanes with respect to the duct exit portion.

21. A crossover duct assembly as set forth in claim 17 wherein said diffuser vanes are each angularly set with respect to the duct entrance portion, each of said vanes having a leading edge incident to radially outward gas flow, and a pressure surface and a suction surface, said suction surface being contoured adjacent the leading edge to form a leading edge wedge angle with respect to the pressure surface of at least about two degrees.

22. A crossover duct assembly as set forth in claim 17 wherein each of said diffuser vanes has a length of at least about seventy-five times its thickness.

23. A crossover duct assembly as set forth in claim 17 wherein the turning bend of said gas flow path is formed to have a generally semi-elliptical cross section, said inner wall including along the turning bend a pair of generally elliptical quadrants each having a ratio of major to minor axis of at least 1.20, and said outer wall including along the turning bend a pair of generally elliptical quadrants each having a ratio of major to minor axis of at least about 1.15.

24. A crossover duct assembly as set forth in claim 23 wherein one of the pair of generally elliptical quadrants of said outer wall along the turning bend is formed by said first outer wall section, and the outer of said outer wall quadrants is formed by said second outer wall section.

25. A crossover duct assembly as set forth in claim 23 wherein one of the pair of generally elliptical quadrants of said inner wall along the turning bend is formed by said first inner wall section, and the other of said inner wall quadrants if formed by said second inner wall quadrant.

26. A crossover duct assembly as set forth in claim 17 wherein said first and second outer wall sections include exteriorly formed flanges, and said second means includes a plurality of bolts received through said flanges for connecting said first and second sections together.

27. A crossover duct assembly as set forth in claim 17 wherein said first outer and inner wall sections include aligned tab-receiving openings, and said diffuser vanes include opposed tabs for reception in said openings whereby said diffuser vanes are mounted along the duct entrance portion for maintaining the spacing between the first outer and inner wall sections.

28. A crossover duct assembly for turning radially outward gas flow to a radially inward direction comprising an annular inner wall and an annular outer wall each having a generally U-shaped cross section anc cooperating to form an annular gas flow path of a generally U-shaped cross section including a gas entrance portion, turning bend and exit portion, said inner wall being formed along the turning bend as a pair of generally elliptical quadrants each having a major to minor axis ratio of at least about 1.20, said outer wall being formed along the turning bend as a pair of generally elliptical quadrants each having a major to minor axis ratio of at least about 1.15, said inner wall and said outer wall each including first and second wall sections along the entrance and exit portions, respectively; first means for connecting said first and second inner wall sections together and with said second outer wall section and for maintaining the spacing between said second outer and inner wall sections to form the duct exit portion; second means for connecting said first and second outer wall sections together; and a plurality of circumferentially spaced diffuser vanes connected between the first outer wall section and said first inner wall section to space the same from each other to form the duct entrance portion and to assist gas flow therethrough, said diffuser vanes each having a leading edge incident to radially outward gas flow, and a pressure surface and a suction surface, said suction surface being contoured adjacent the leading edge to form a leading edge wedge angle with respect to the pressure surface of at least two degrees.

29. A crossover duct assembly as set forth in claim 28 wherein said first means comprises a plurality of deswirl vanes extending between the second duct outer wall section and the second inner wall section, and fastening means for fastening said deswirl vanes in position with respect to said second section and said first and second inner wall sections.

30. A crossover duct assembly as set forth in claim 28 wherein said first inner wall section forms one of said pair of elliptical inner wall quadrants and said second inner wall section forms the other of said inner wall quadrants.

31. A crossover duct assembly as set forth in claim 28 wherein said first and second outer wall sections include exteriorly formed flanges, and said second means includes a plurality of bolts received through said flanges for connecting said first and second sections together.

32. In a multiple stage compressor having at least two compressor stages carried within a housing, a crossover duct assembly between adjacent compressor stages for turning radially outward gas flow to a radially inward direction comprising an annular inner wall and an annular outer wall each having a generally U-shaped cross section and cooperating to form an annular gas flow path of generally U-shaped cross section including a gas entrance portion, a turning bend and an exit portion, said inner wall and said outer wall each including a first wall section along the entrance portion and a portion of the turning bend and a second wall section along the exit portion and a portion of the turning bend; first means including a plurality of circumferentially spaced deswirl vanes along the exit portion for connecting said second outer wall section with respect to said first and second inner wall sections and for maintaining the spacing between said second outer and inner wall sections to form the duct exit portion; second means including a plurality of relatively thin circumferentially spaced diffuser vanes along the entrance portion for connecting said first and second outer wall sections to each other and for maintaining the spacing between said first outer wall section and said first inner wall section; and third means for mounting the crossover duct assembly with respect to the compressor housing.

33. A crossover duct assembly as set forth in claim 32 wherein each of said diffuser vanes has a leading edge incident to radially outward gas flow, and a pressure surface and a suction surface, said suction surface being contoured adjacent the leading edge to form a leading edge wedge angle with respect to the pressure surface of at least about two degrees.

34. A crossover duct assembly as set forth in claim 32 wherein the turning bend of said gas flow path is formed to have a generally semi-elliptical cross section, said inner wall including along the turning bend a pair of generally elliptical quadrants each having a ratio of major to minor axis of at least 1.20, and said outer wall including along the turning bend a pair of generally elliptical quadrants each having a ratio of major to minor axis of at least about 1.15.

35. A crossover duct assembly as set forth in claim 34 wherein said first inner wall section forms one of said pair of elliptical inner wall quadrants and said second inner wall section forms the other of said inner wall quadrants.

36. A crossover duct assembly as set forth in claim 32 wherein said first and second outer wall sections include exteriorly formed flanges, and said second means includes a plurality of bolts received through said flanges for connecting said first and second sections together.

37. A crossover duct assembly as set forth in claim 32 wherein said first outer wall section and said first inner wall section along the entrance portion include aligned tab-receiving openings, and said diffuser vanes each include opposed tabs for reception in said openings whereby said diffuser vanes are mounted between said first outer wall section and first inner wall section for maintaining the spacing therebetween.

38. A crossover duct assembly as set forth in claim 35 wherein said first means includes a series of bolt-receiving bosses formed exteriorly on said first inner wall section for positioning said first and second inner wall sections with respect to each other, and a plurality of bolts received through said second inner and outer wall sections and said deswirl vanes and fastened into said bosses.

39. A method of making a crossover duct assembly for turning radially outward gas flow to a radially inward direction comprising the steps of forming a generally U-shaped inner wall and a generally U-shaped outer wall each including first and second wall sections for cooperating with each other to form a generally U-shaped gas flow path having a gas entrance portion, a turning bend, and an exit portion; connecting said second outer wall section with respect to said first and second inner wall sections and spaced from said second inner wall section to form the duct exit portion; mounting a plurality of relatively thin diffuser vanes between said first outer wall section and said first inner wall section to space said wall sections from each other to form the duct entrance portion and to assist gas flow therethrough; and connecting said first and second outer wall sections together to form the duct assembly.

40. The method of claim 39 wherein said steps of forming said inner and outer walls includes forming said walls to have a generally annular shape and a generally U-shaped cross section whereby said walls cooperate to form a generally annular flow path with a generally U-shaped cross section.

41. The method of claim 40 wherein said mounting step includes circumferentially spacing said diffuser vanes within the gas entrance portion.

42. The method of claim 41 including the step of forming each of said diffuser vanes to have a leading edge incident to radially outward gas flow, and a pressure surface and a suction surface, said suction surface being contoured adjacent the leading edge to form a leading edge wedge angle with respect to the pressure surface of at least about two degrees.

43. The method of claim 41 including the step of forming each of said diffuser vanes to have a length of at least about seventy-five times its thickness.

44. The method of claim 39 including the step of forming said first outer wall section to extend along the gas entrance portion and at least part of the turning bend, and forming said second outer wall section to extend along the gas exit portion and at least part of the turning bend.

45. The method of claim 39 wherein said step of connecting said first and second outer wall sections together includes forming abutting flanges on said wall sections exteriorly of the gas flow path, and fastening a plurality of bolts through said flanges.

46. The method of claim 39 wherein said step of mounting said diffuser vanes includes forming a plurality of aligned sets of tab-receiving openings in said first outer wall section and said first inner wall section along the duct entrance portion, and receiving opposed tabs formed on said vanes within said aligned sets of openings.

47. The method of claim 39 wherein said step of connecting said second outer wall section with respect to said inner wall sections includes the steps of positioning a plurality of deswirl vanes between said second outer wall section and said second inner wall section, and interconnecting said second outer wall section and said first and second inner wall sections with fastening means whereby said deswirl vanes are secured in position and maintain the spacing between said walls.

48. The method of claim 47 including the step of angularly securing said deswirl vanes with respect to the duct exit portion.

49. The method of claim 47 wherein said step of interconnecting said second outer wall section and said first and second inner wall sections includes connecting said second outer wall section and said inner wall sections together with bolts received through said deswirl vanes.

50. The method of claim 49 wherein said step of forming said inner wall includes forming said inner wall first section to extend along the duct entrance portion and said second inner wall section to extend along the duct exit portion, said first inner wall section including exteriorly formed bolt-receiving bosses for positioning said first and second inner wall sections wiht respect to each other and for receiving said bolts received through said deswirl vanes for connecting said first and second inner wall sections with respect to said second outer wall section.

51. The method of claim 39 wherein said steps of forming said inner and outer walls includes forming the generally U-shaped gas flow path with a generally semi-elliptical turning bend configuration, said inner wall being formed by a pair of generally elliptical quadrants each with a major to minor axis ratio of at least about 1.20, said outer wall being formed by a pair of generally elliptical quadrants each with a major to minor axis of at least about 1.15.

52. The method of claim 51 including the step of forming said first and second outer wall sections each to include one of said outer wall elliptical quadrants.

53. The method of claim 51 including the steps of forming said inner wall to include first and second inner wall sections each including one of said inner wall elliptical quadrants.

54. A method of making a crossover duct assembly for turning radially outward gas flow to a radially inward direction comprising the steps of forming a generally annular inner wall and a generally annular outer wall each having a generally U-shaped cross section and cooperating to form an annular gas flow path of a generally U-shaped cross section including a gas entrance portion, a turning bend, and an exit portion, said inner and outer walls each having a first section along the entrance portion and at least part of the turning bend, and a second section along the exit portion and at least part of the turning bend; positioning a plurality of circumferentially spaced deswirl vanes between the second inner and outer wall sections; connecting said second inner and outer wall sections with respect to each other and with respect to said first inner wall section; positioning a plurality of relatively thin diffuser vanes between said first inner and outer wall sections; and connecting said first and second outer wall sections together to form the duct assembly.

55. The method of claim 54 including the step of forming each of said diffuser vanes to have a leading edge incident to radially outward gas flow, and a pressure surface and a suction surface, said suction surface being contoured adjacent the leading edge to form a leading edge wedge angle with respect to the pressure surface of at least about two degrees.

56. The method of claim 54 wherein said steps of forming said inner and outer walls includes forming the generally U-shaped gas flow path with a generally semi-elliptical turning bend configuration, said inner wall being formed by a pair of generally elliptical quadrants each with a major to minor axis ratio of at least about 1.20, said outer wall being formed by a pair of generally elliptical quadrants each with a major to minor axis of at least about 1.15.

57. A method of making a crossover duct assembly for turning radially outward gas flow to a radially inward direction comprising the steps of forming a generally annular inner wall and a generally annular outer wall each having a generally U-shaped cross section and cooperating to form an annular gas flow path of a generally semi-elliptical cross section including a gas entrance portion, a turning bend, and an exit portion, said inner wall being formed by a pair of generally elliptical quadrants each with a major to minor axis ratio of at least about 1.20, said outer wall being formed by a pair of generally elliptical quadrants each with a major to minor axis of at least 1.15, said inner and outer walls each having a first section along the entrance portion and at least part of the turning bend, and a second section along the exit portion and at least part of the turning bend; positioning a plurality of circumferentially spaced deswirl vanes between the second inner and outer wall sections; connecting said second inner and outer wall sections with respect to each other and with respect to said first inner wall section; positioning a plurality of relatively thin diffuser vanes between said first inner and outer wall sections; each of said diffuser vanes being formed to have a leading edge incident to radially outward gas flow, and a pressure surface and a suction surface, said suction surface being contoured adjacent the leading edge to form a leading edge wedge angle with respect to the pressure surface of at least about two degrees; and connecting said first and second outer wall sections together to form the duct assembly. with respect to the compressor housing.

* * * * *

UNITED STATES PATENT AND TRADEMARK OFFICE

CERTIFICATE OF CORRECTION

PATENT NO. : 4,251,183

DATED : February 17, 1981

INVENTOR(S) : Hsin-Tuan Liu et al

It is certified that error appears in the above-identified patent and that said Letters Patent are hereby corrected as shown below:

Column 9, line 32, change "anc" to --and--;

Column 12, line 19, change "wiht" to --with--;

Column 14, line 19, delete entire line.

Signed and Sealed this

*Twenty-third* Day of *June 1981*

[SEAL]

*Attest:*

RENE D. TEGTMEYER

*Attesting Officer*

*Acting Commissioner of Patents and Trademarks*